US010173460B2

(12) United States Patent
Lupelow

(10) Patent No.: US 10,173,460 B2
(45) Date of Patent: Jan. 8, 2019

(54) DEVICE AND METHOD FOR SEALING CONTAINERS

(71) Applicant: University of North Dakota, Grand Forks, ND (US)

(72) Inventor: Michael Lupelow, Maplewood, MN (US)

(73) Assignee: University of North Dakota, Grand Forks, ND (US)

( * ) Notice: Subject to any disclaimer, the term of this patent is extended or adjusted under 35 U.S.C. 154(b) by 687 days.

(21) Appl. No.: 13/757,407

(22) Filed: Feb. 1, 2013

(65) Prior Publication Data

US 2014/0215975 A1 Aug. 7, 2014

(51) Int. Cl.
*B44D 3/12* (2006.01)

(52) U.S. Cl.
CPC ..... *B44D 3/12* (2013.01)

(58) Field of Classification Search
CPC ..... B44D 3/12; B65D 25/10; B65D 51/16
USPC ..... 53/485; 220/216, 580, 227; 141/319, 141/332, 340, 363
See application file for complete search history.

(56) References Cited

U.S. PATENT DOCUMENTS 1,603,665 A * 10/1926 Deane ..... B65D 51/16 220/372
3,469,735 A * 9/1969 Burt ..... B65D 25/50 220/698
3,492,773 A * 2/1970 Bergstrom ..... B29C 51/00 220/606
3,786,616 A * 1/1974 Nalbach ..... B65B 31/003 53/88
4,435,942 A * 3/1984 Zaltsman ..... B65D 39/0017 53/485
4,771,903 A * 9/1988 Levene ..... B65B 7/2878 156/69
4,784,709 A * 11/1988 Unger ..... B29C 65/0672 156/580
5,160,067 A * 11/1992 Luber ..... B65D 43/0218 220/698

(Continued)

OTHER PUBLICATIONS

Internet website, "Paint Can Closer," The Cary Company, www.thecarycompany.com/containers/tools/paintcancloser.html, accessed Dec. 28, 2012.

(Continued)

*Primary Examiner* — Sameh Tawfik
(74) *Attorney, Agent, or Firm* — Kinney & Lange, P.A.

(57) ABSTRACT

An elongate, preferably rigid housing having a frusto-conical shape and a method for using the same. The large diameter end of the housing is generally adapted to be contacted with the lid of a container to ensure optimal sealing, while that portion of the frusto-conical housing having a small diameter is adapted to, either directly or indirectly, receive forces. The large diameter end is preferably at least partially hollow, and further comprises an inner member adapted to be contacted with smaller lids. Optionally, the small diameter end may be further characterized by a projection extending about the longitudinal axis of the device. For example, the projection may be cylindrical or frusto-conical. The small diameter end may further be characterized by having a recessed portion adapted to receive a tool, such as a conventional paint can opener.

18 Claims, 6 Drawing Sheets

(56) References Cited

U.S. PATENT DOCUMENTS 5,213,230 A * 5/1993 Kral ..... B65D 81/245 220/216
5,339,981 A * 8/1994 Kral ..... B65D 81/245 220/227
D363,429 S * 10/1995 Lee ..... D9/454
6,539,991 B1 * 4/2003 Ackerman ..... B44D 3/128 141/311 A
6,705,480 B1 * 3/2004 Saddler ..... B44D 3/12 220/4.03
6,802,920 B2 * 10/2004 Shinohara ..... B29C 65/082 156/580.2
6,945,690 B2 * 9/2005 Armendariz ..... B01F 15/0074 366/209
7,674,194 B2 * 3/2010 Lortscher ..... A63B 69/0002 473/417
8,052,027 B2 * 11/2011 Williamson ..... B21D 51/26 156/580.2
8,272,255 B2 * 9/2012 Halverson ..... G01N 1/18 422/527
8,371,483 B2 * 2/2013 Sanford ..... B67C 9/00 141/340
8,608,206 B2 * 12/2013 Fedale, Sr. ..... E04D 13/1407 277/636
8,833,825 B2 * 9/2014 Holmes ..... B02C 2/005 294/215

OTHER PUBLICATIONS

Internet website, "Paint Can Sealers," Freund Container & Supply, www.freundcontainer.com/paint-can-sealers/p/7855, accessed Dec. 28, 2012.

Internet website, "Hand Operated Open Top Can Sealers," Freund Container & Supply, www.freundcontainer.com/hand-operated-open-top-can-sealers-heavy-duty-hand-crank/p/v1225T01.

* cited by examiner

DEVICE AND METHOD FOR SEALING CONTAINERS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

Field of the Invention

This disclosure concerns devices and methods for sealing containers. More specifically, this disclosure concerns a device for sealing containers, such as conventional paint cans, having a separate lid that fits into a specially adapted opening.

Background Art

Conventionally, containers such as paint cans are sealed by contacting or striking a lid with blunt force, such as via a hammer or mallet, thereby driving the lid into frictional engagement with a corresponding opening about the container. One primary disadvantage of such conventional means, particularly in the case of cylindrical containers with round, flat lids, is the need to strike the lid multiple times around its perimeter. Many times, this results in uneven application of forces, splatter of contents, incomplete sealing which may lead to evaporation, premature spoilage, etc., and the necessity of having to make multiple, potentially noisy strikes at various points along the perimeter of the lid.

Mechanical can sealers are known in the art, but they are generally large, bulky, difficult to operate, and expensive to produce or maintain. See, e.g., "Paint Can Closer," The Cary Company, www.thecarycompany.com/containers/tools/paintcancloser.html, accessed Dec. 28, 2012; "Paint Can Sealers," Freund Container & Supply, www.freundcontainer.com/paint-can-sealers/p/7855, accessed Dec. 28, 2012; "Hand Operated Open Top Can Sealers," Freund Container & Supply, www.feundcontainer.com/hand-operated-open-top-can-sealers-heavy-duty-hand-crank/p/v1225T01, accessed Dec. 28, 2012. Ordinary consumers typically do not have access to, nor an economic incentive to obtain, one of these devices, especially for small, occasional, or one-time household painting projects.

There exists a need for an economical, convenient, and easy-to-use device for ensuring the optimal and efficient sealing of containers such as paint cans.

BRIEF SUMMARY OF THE INVENTION

The device described herein comprises an elongate, preferably rigid housing having a frusto-conical shape. Also described herein is a method for using the same. The large diameter end of the housing is generally adapted to be contacted with the lid of a container, while that portion of the frusto-conical housing having a small diameter is adapted to, either directly or indirectly, receive forces. The large diameter end is preferably at least partially hollow, and further comprises an inner member adapted to be contacted with smaller lids. Optionally, the small diameter end may be further characterized by a projection extending about the longitudinal axis of the device. For example, the projection may be cylindrical or frusto-conical. The small diameter end may further be characterized by having a recessed portion adapted to receive a tool, such as a conventional paint can opener.

DETAILED DESCRIPTION OF THE INVENTION

Figure 1:
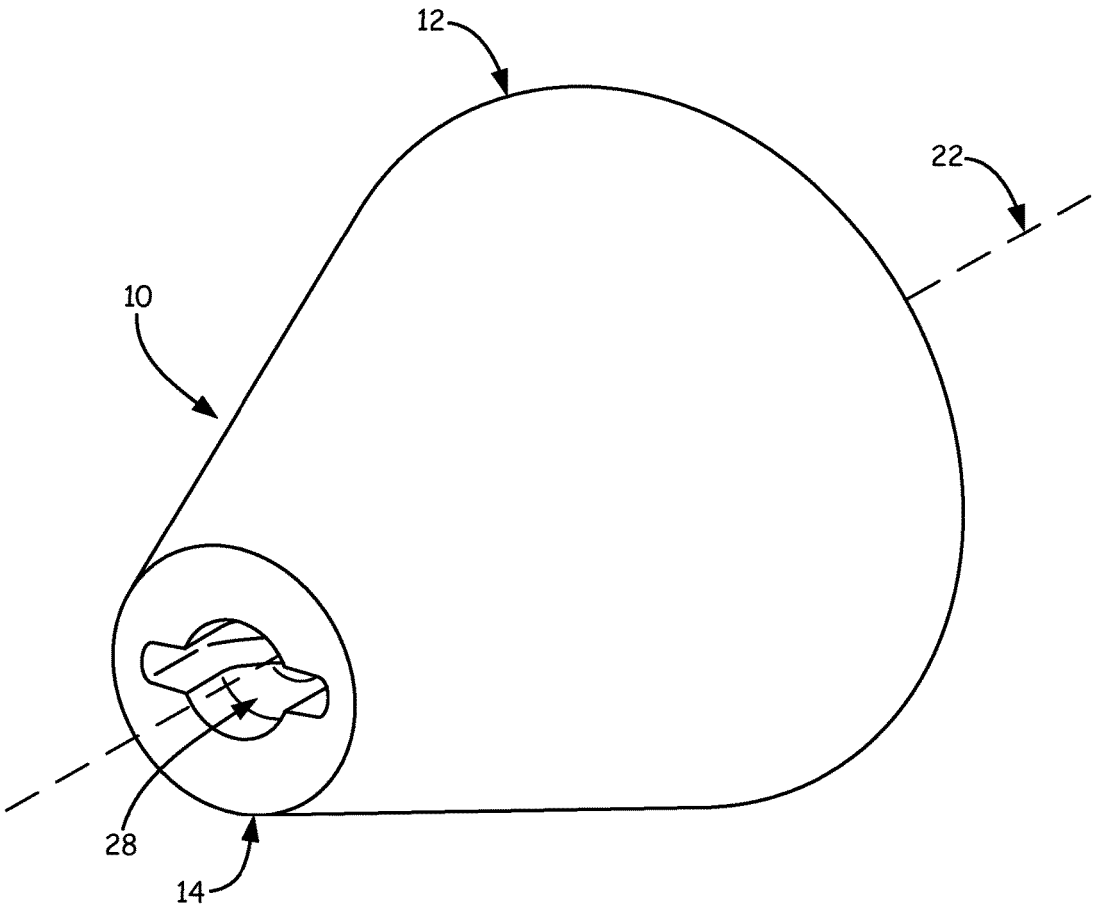
FIG. 1 depicts a perspective view of an embodiment of the disclosed device.
Figure 2:
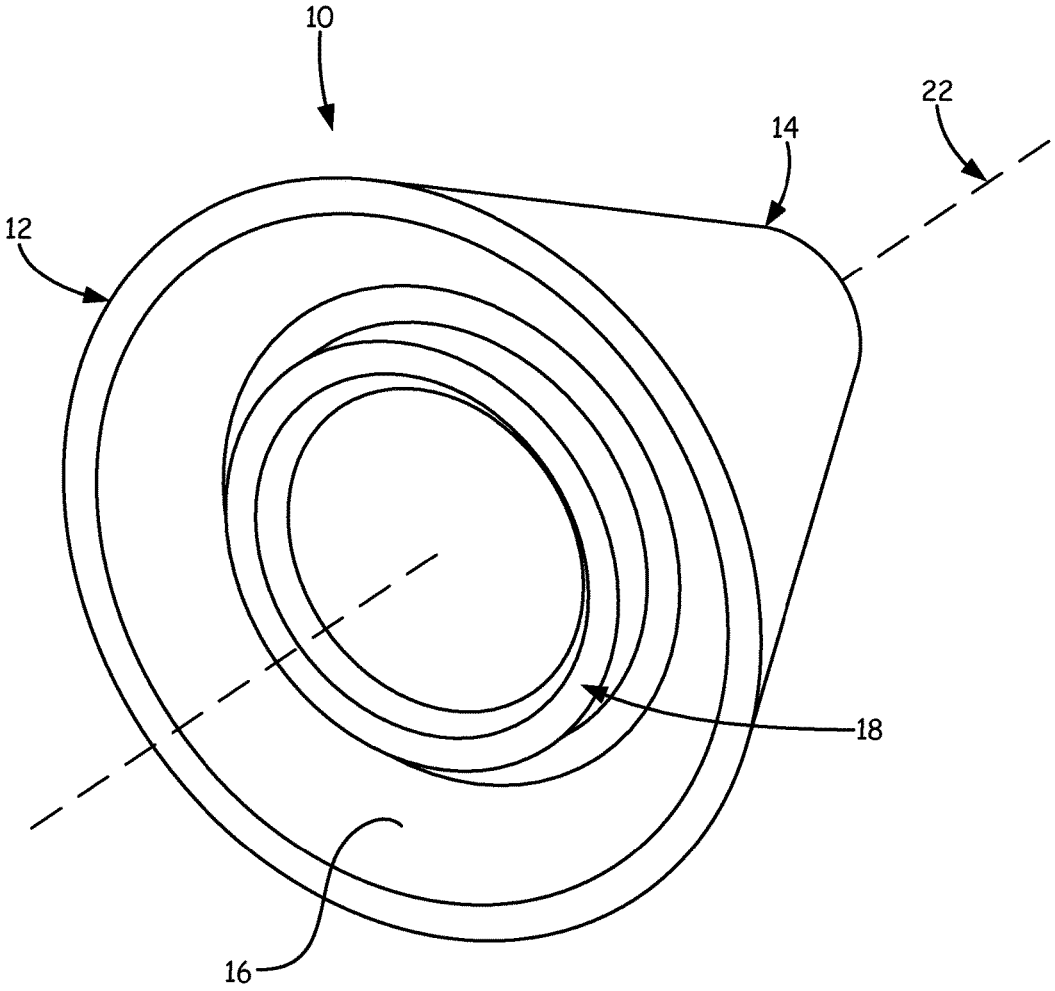
FIG. 2 depicts a perspective view of an embodiment of the disclosed device.

As illustrated in FIG. 1, device 10 comprises a frusto-conical housing having a large diameter end 12 and a small diameter end 14. Turning now to FIG. 2, large diameter end 12 comprises a hollow area 16. Disposed within hollow area 16 is a raised inner member 18. Preferably, raised inner member 18 is a concentric ring, said ring necessarily having a diameter less than that of large diameter end 12. In one exemplary embodiment, the outer diameter of large diameter end 12 is between approximately 5 and 5¼ inches, so as to approach—but not exceed—the diameter of conventional, one-gallon paint cans which are well known in the art. Also by way of example, raised inner member 18 has an outer diameter of between approximately 3¼ and 3½ inches, so as to approach, but not exceed, the diameter of conventional, one-quart paint cans which are well known in the art.

It will be appreciated that the ends of cans of smaller diameter, when contacted with raised inner member 18, will fit within the space defined by hollow area 16 but, when centered, will not contact large diameter end 12. It will further be appreciated that a device 10 having different dimensions could be utilized for any number of containers.

Figure 3:
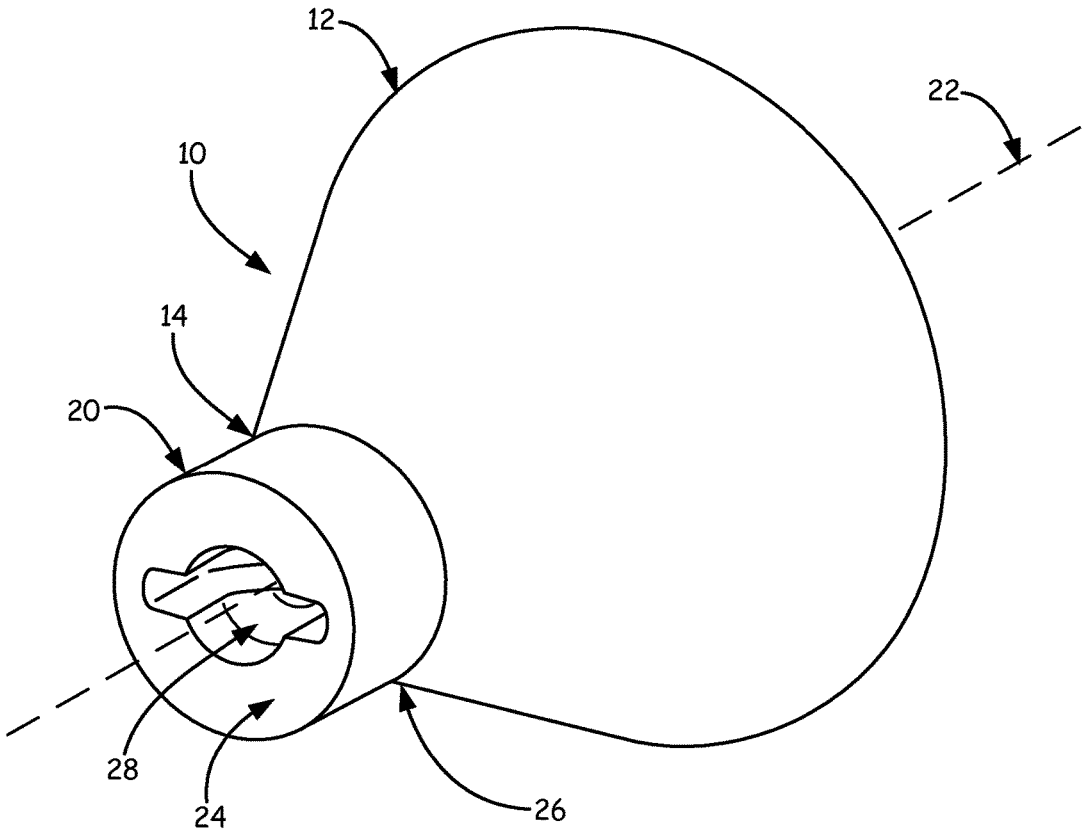
FIG. 3 depicts a perspective view of a first alternative embodiment of the disclosed device.
Figure 4:
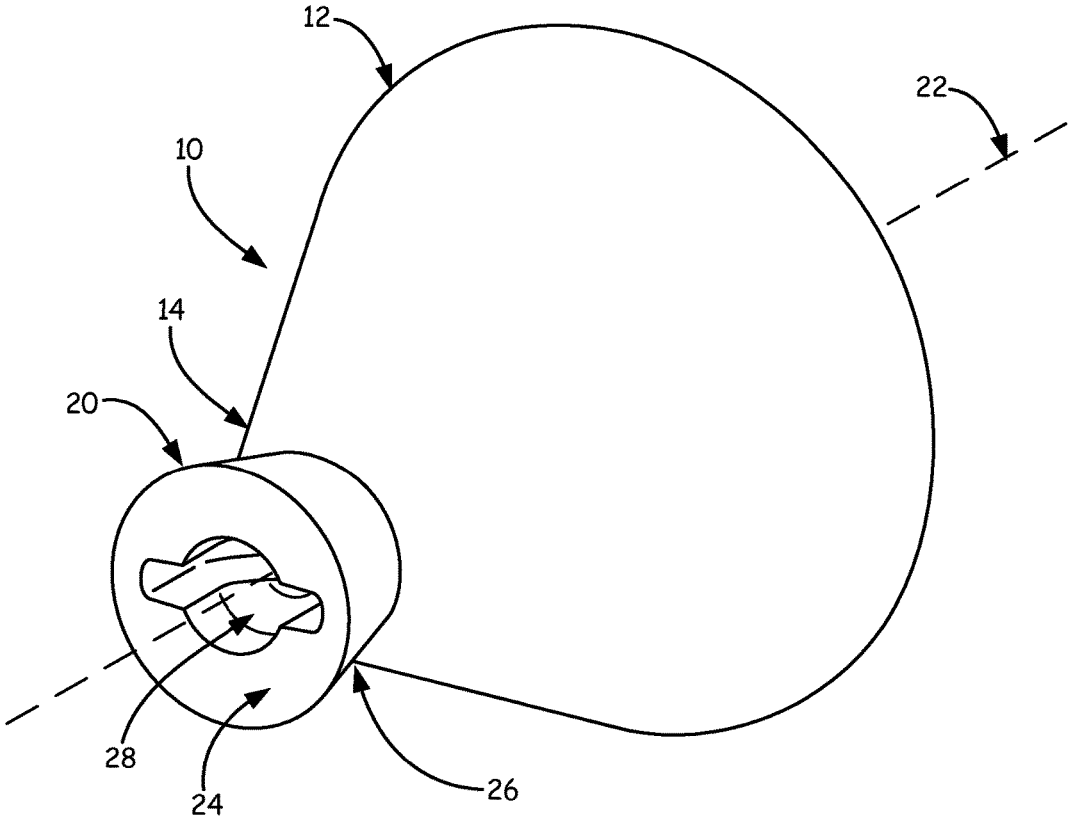
FIG. 4 depicts a perspective view of a second alternative embodiment of the disclosed device.

Turning to FIGS. 3 and 4, small diameter end 14 may optionally comprise a projection 20 extending away from large diameter end 12 about the longitudinal axis 22 of device 10. Projection 20 may be any size or shape but is preferably cylindrical (FIG. 3) or frusto-conical (FIG. 4). With respect to the earlier disclosed embodiment for gallon- and quart-size containers, the radius of small diameter end 14 or, correspondingly, of the distal end 24 of projection 20, is preferably around 1.5 inches.

It will be appreciated that in each of the embodiments depicted in FIGS. 3 and 4, a neck 26 is defined at the junction between small diameter end 14 and projection 20. It has been observed that the highest stresses on device 10 during loading occur at neck 26, with minimal deformation or displacement at large diameter end 12. The stresses along the circumference of large diameter end 12 are generally even, even accounting for human error in striking projection 20 with an implement such as a hammer.

Figure 5:
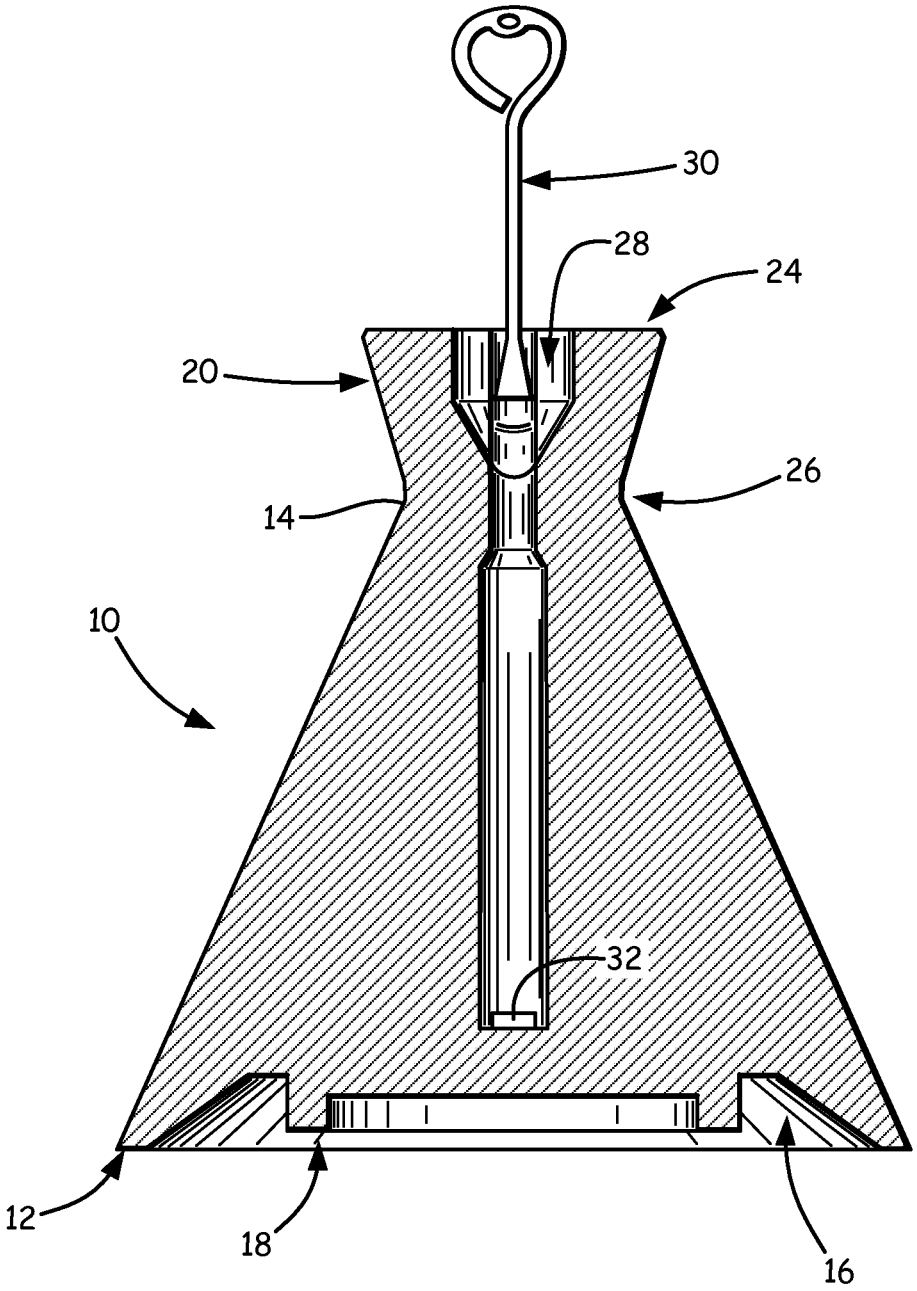
FIG. 5 shows a cross-section view of an alternative embodiment of the disclosed device.

As shown in any of FIGS. 1, 3, and 4, the end of device 10 opposite large diameter end 12 further comprises a recessed portion 28. As shown in cross-section in FIG. 5, recessed portion 28 is preferably adapted to receive an elongate tool 30, such as a conventional paint can opener, which is well known in the art. It will be apparent that the depth of recessed portion 28 need only be slightly greater than the length of tool 30 that is to reside therein. To permit convenient access to tool 30, the length of recessed portion 28 is preferably slightly shorter than the length of tool 30, so that the user may grasp one the exposed end of tool 30. In yet another embodiment, recessed portion 28 further comprises a magnet 32 in communication therewith. Magnet 32 may engage a portion of tool 30, thereby serving to more securely retain tool 30 within recessed portion 28.

Device 10 is preferably unitary in construction and is preferably made of rigid material. While several methods of manufacture are known in the art, one such method entails injection molding utilizing acrylonitrile butadiene styrene (ABS). Other methods include providing a solid block of material and cutting the block using a lathe or other similar machines. Other materials may be used as well; preferably they are lightweight and have high impact strength.

Figure 6:
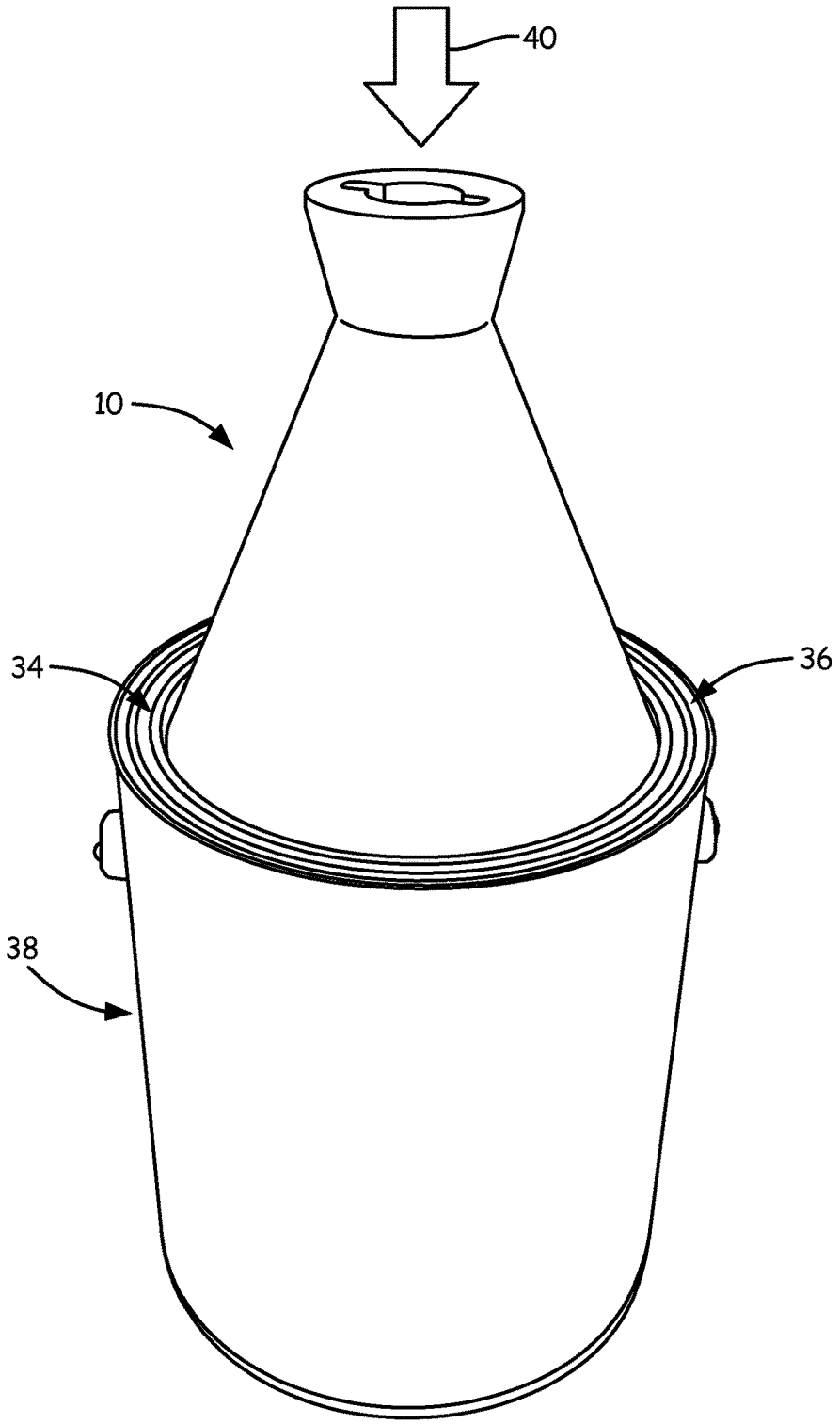
FIG. 6 depicts a perspective view the disclosed device and method.

Turning to FIG. 6, device 10 is utilized by contacting, in this instance, large diameter end 12 with a lid 34 proximate opening 36 on container 38. It will be appreciated that containers of smaller diameter could be contacted with raised inner member 18. Container 38 may be any conventional container, such as a tin-coated steel can. Examples of these include paint cans, frequently encountered in quart and gallon sizes, as well as various other types of containers, including but not limited to drums and barrels. Container 38 and lid 34 are adapted to frictionally engage within opening 36, as is well known in the art. Downward force, illustrated by arrow 40, is applied to device 10 and transmitted to lid 34. Force 40 may be applied using any number of conventional tools, such as hammers or mallets, or even manual force. Force 40 may be applied in a single action or multiple actions.

Tool 30, adapted for opening containers such as paint cans, may be retained in recessed portion 28, secured partially by magnet 32, for the user's convenience.

Whereas, the present invention has been described in relation to the drawings attached hereto, it should be understood that other and further modifications, apart from those shown or suggested herein, may be made within the spirit and scope of this invention.

I claim:

1. A device to seal a lid onto an open container, the device comprising:

a frusto-conical housing disposed substantially symmetrically about an axis, the frusto-conical housing comprising:

a large diameter end situated at an outer axial extent of the frusto-conical housing, and having a first outer diameter, the large diameter end having a hollow portion that defines a recess proximate and radially inward of the large diameter end;

a small diameter end distal from the large diameter end and having a second outer diameter less than the first outer diameter; and an axially raised inner member disposed within the recess having a radially inner and outer axially extending surfaces, wherein the radially outer axially extending surface is situated at a third outer diameter less than the first outer diameter, and wherein the axially raised member has an axial extent less than the outer axial extent.

2. The device of claim 1 wherein said axially raised inner member is a ring concentric with said large diameter end.

3. The device of claim 2 wherein an outer diameter of said ring is between approximately 3¼ and 3½ inches.

4. The device of claim 3 wherein the outer diameter of said ring is approximately 3.4 inches.

5. The device of claim 1 wherein an outer diameter of said large diameter end is between approximately 5 and 5¼ inches.

6. The device of claim 5 wherein the outer diameter of said large diameter end is approximately 5.1 inches.

7. The device of claim 1 wherein said small diameter end further comprises a projection extending about the longitudinal axis of said housing.

8. The device of claim 7 wherein said projection is selected from the group consisting of a cylindrical projection and a frusto-conical projection.

9. The device of claim 7 wherein said projection further comprises a recessed portion adapted to receive a tool.

10. The device of claim 9 wherein said tool is a paint can opener.

11. The device of claim 9 further comprising a magnet in communication with said recessed portion.

12. The device of claim 1 wherein said housing is rigid.

13. The device of claim 12 wherein said housing is acrylonitrile butadiene styrene.

14. The device of claim 1, wherein said large diameter end and said axially raised inner member are configured to engage with a lid of a container for sealing said lid and said container.

15. The device of claim 14, wherein the large diameter end is sized to engage with the lid of a conventional, one-gallon paint container, and wherein the axially raised inner member is sized to engage with the lid of a conventional, one-quart paint container.

16. A device to seal a lid onto an open container, the device comprising:

a frusto-conical housing comprising:

a large diameter end with an outer diameter of approximately 5.1 inches, wherein said large diameter end is situated at a first axial end of the frusto-conical housing, and is sized to engage with a lid of a conventional, one-gallon paint container to seal said lid and said container; and a small diameter end with an outer diameter of approximately 1.5 inches, situated at a second axial end of the frusto-conical housing distal from the first axial end;

wherein said housing having a hollow portion proximate said large diameter end, and wherein said small diameter end comprises a recessed portion adapted to receive a tool;

an axially raised concentric ring disposed within said hollow portion and having a radially outer axially extending surface with a diameter of approximately 3.4 inches, wherein said axially raised concentric ring is sized to engage with a lid of a conventional, one-quart paint container for sealing said lid and said container, and is axially recessed within the large diameter end, wherein the axially raised concentric ring is situated axially inboard of the first axial end of the frusto-conical housing; and a magnet in communication with said recessed portion.

17. The device of claim 16 further comprising a projection extending about the longitudinal axis of said housing.

18. The device of claim 17 wherein the distal end of said projection has an outer diameter of approximately 1.5 inches.

* * * * *